US008887873B2

(12) United States Patent
Washio et al.

(10) Patent No.: US 8,887,873 B2
(45) Date of Patent: Nov. 18, 2014

(54) ELEVATOR DEVICE

(75) Inventors: Kazunori Washio, Tokyo (JP); Rikio Kondo, Tokyo (JP); Masunori Shibata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 604 days.

(21) Appl. No.: 13/265,237

(22) PCT Filed: Jun. 16, 2010

(86) PCT No.: PCT/JP2010/060217

§ 371 (c)(1),
(2), (4) Date: Oct. 19, 2011

(87) PCT Pub. No.: WO2011/001829

PCT Pub. Date: Jan. 6, 2011

(65) Prior Publication Data

US 2012/0043166 A1 Feb. 23, 2012

(30) Foreign Application Priority Data

Jun. 29, 2009 (JP) ..... 2009-153376

(51) Int. Cl.

| | |
|---|---|
| ***B66B 1/34*** | (2006.01) |
| ***B66B 5/02*** | (2006.01) |
| ***B66B 5/00*** | (2006.01) |
| ***B66B 5/06*** | (2006.01) |

(52) U.S. Cl.

CPC ..... *B66B 5/02* (2013.01); *B66B 5/0031* (2013.01); *B66B 5/0018* (2013.01); *B66B 5/06* (2013.01)

USPC ..... 187/393; 187/247

(58) Field of Classification Search

CPC ..... B66B 5/06; B66B 5/0018; B66B 5/02; B66B 5/0031

USPC ..... 187/247, 248, 391, 393

See application file for complete search history.

(56) References Cited

U.S. PATENT DOCUMENTS 3,961,688 A * 6/1976 Maynard ..... 187/289
4,265,337 A * 5/1981 Dammeyer ..... 187/224

(Continued)

FOREIGN PATENT DOCUMENTS

CN 1953925 A 4/2007
DE 696 22 655 T2 4/2003

(Continued)

OTHER PUBLICATIONS

Office Action issued Aug. 20, 2013 in Japanese Patent Application No. 2011-520861 with English language translation.

(Continued)

*Primary Examiner* — Anthony Salata

(74) *Attorney, Agent, or Firm* — Oblon, Spivak, McClelland, Maier & Neustadt, L.L.P.

(57) ABSTRACT

In an elevator device, a signal diagnosis device includes: a signal input section to which a sensor signal from a sensor is input; a disconnection detecting section for outputting a diagnosis signal for detecting disconnection to the sensor and detecting a state of a signal turned back at the sensor to be input so as to detect whether or not disconnection of the signal from the sensor occurs; a switch for turning ON/OFF an input of the signal to the disconnection detecting section; and a disconnection-detection diagnosis section for operating the switch to diagnose whether or not the disconnection detecting section functions normally. Further, a car is stopped when occurrence of the disconnection is determined by the signal diagnosis device or when an abnormality is detected by the disconnection-detection diagnosis section.

11 Claims, 7 Drawing Sheets

(56) References Cited

U.S. PATENT DOCUMENTS

| | | | | |
|---|---|---|---|---|
| 4,898,263 | A * | 2/1990 | Manske et al. | 187/247 |
| 4,930,604 | A * | 6/1990 | Schienda et al. | 187/393 |
| 5,057,699 | A * | 10/1991 | Spence | 307/98 |
| 5,107,964 | A * | 4/1992 | Coste et al. | 187/280 |
| 5,392,879 | A * | 2/1995 | Boyce et al. | 187/393 |
| 5,400,204 | A | 3/1995 | Oshima et al. | |
| 5,557,546 | A * | 9/1996 | Fukai et al. | 702/185 |
| 5,952,627 | A * | 9/1999 | Park | 187/393 |
| 6,193,019 | B1 * | 2/2001 | Sirigu et al. | 187/391 |
| 6,467,585 | B1 * | 10/2002 | Gozzo et al. | 187/391 |
| 7,503,435 | B2 * | 3/2009 | Tyni et al. | 187/391 |

FOREIGN PATENT DOCUMENTS

| | | | |
|---|---|---|---|
| EP | 0 767 133 | B1 | 4/1997 |
| JP | 2 233486 | | 9/1990 |
| JP | 7 63805 | | 3/1995 |
| JP | 7 280865 | | 10/1995 |
| JP | 8-12214 | A | 1/1996 |
| JP | 8 502123 | | 3/1996 |
| JP | 10 224198 | | 8/1998 |
| JP | 2000 232360 | | 8/2000 |
| JP | 2001-218865 | A | 8/2001 |
| JP | 2005-170605 | A | 6/2005 |
| WO | WO 2006/090470 | A1 | 8/2006 |
| WO | 2006 106575 | | 10/2006 |

OTHER PUBLICATIONS

International Search Report issued Aug. 24, 2010 in PCT/JP10/060217 filed Jun. 16, 2010.

German Office Action issued Apr. 23, 2014, in German Patent Application No. 11 2010 002 756.0 (with English Translation).

Japanese Office Action issued Apr. 16, 2013 in Patent Application No. 2011-520861 with English Summary.

Office Action issued May 13, 2013 in Chinese Application No. 201080024092.7 (With English Translation).

* cited by examiner

ELEVATOR DEVICE

TECHNICAL FIELD

The present invention relates to an elevator device including a sensor for generating a signal according to a state of a car, in particular, to detection of disconnection of a signal line from the sensor.

BACKGROUND ART

In a conventional signal transmission device for an elevator, diagnosis signals are transmitted to a plurality of pieces of terminal equipment at a time in a predetermined cycle by diagnosis-signal generation means of an elevator controller. When the diagnosis signals are input to the pieces of terminal equipment, reply signals are output from the pieces of terminal equipment to abnormality detection means. The abnormality detection means checks the replay signal from each piece of the terminal equipment as often as the number of diagnosis signals. Computation means for generating the reply signal in response to the diagnosis signal is provided to each piece of the terminal equipment (for example, see Patent Literature 1).

Moreover, in a conventional abnormality detection device for electric equipment, a pulse which does not interfere with an operation of an electric circuit is superimposed on a normal input signal and is input to the electric circuit. Only when the pulse is output from an output side of the electric circuit, control in a next stage is executed (for example, see Patent Literature 2).

CITATION LIST

Patent Literature

Patent Literature 1: JP 04-261243 A
Patent Literature 2: JP 07-280865 A

SUMMARY OF INVENTION

Technical Problem

In such conventional signal transmission device for an elevator as described in Patent Literature 1, the computation means is required to be provided to each piece of the terminal equipment so as to detect the disconnection of a wiring between the terminal equipment and the elevator controller. Therefore, the signal transmission device described above cannot be used for detecting the disconnection of a wiring from a simple sensor such as a switch.

Moreover, in such conventional abnormality detection device for electric equipment as described in Patent Literature 2, when a failure occurs in a disconnection detection circuit, there is a fear in that the control is performed based on an erroneous signal.

The present invention has been made to solve the problems described above, and therefore has an object to provide an elevator device with a simple configuration, which is capable of more reliably detecting disconnection of a signal from a sensor to improve reliability.

Solution to Problems

According to the present invention, there is provided an elevator device, including a signal diagnosis device, the signal diagnosis device including: a signal input section to which a sensor signal from a sensor for generating a signal according to a state of a car is input; a disconnection detecting section for outputting a diagnosis signal for detecting disconnection to the sensor and detecting a state of a signal turned back at the sensor to be input so as to detect whether or not disconnection of the signal from the sensor occurs; a switch for turning ON/OFF an input of the signal to the disconnection detecting section; and a disconnection-detection diagnosis section for operating the switch to diagnose whether or not the disconnection detecting section functions normally, in which the car is stopped when occurrence of the disconnection is determined by the signal diagnosis device or when an abnormality is detected by the disconnection-detection diagnosis section.

Further, according to the present invention, there is provided an elevator device, including a signal diagnosis device, the signal diagnosis device including: a signal input section to which a sensor signal from a sensor for generating a signal according to a state of a car is input; a disconnection-detection-signal output section for outputting a diagnosis signal for detecting disconnection to the sensor signal from the sensor when a diagnosis for disconnection is conducted; a disconnection determining section for comparing an input signal from the sensor and an output signal from the disconnection-detection-signal output section with each other to determine whether or not the disconnection of the signal from the sensor occurs; and a disconnection-detection-signal block section for blocking the output signal from the disconnection-detection-signal output section other than when the diagnosis for the disconnection is conducted and determining occurrence of an abnormality when detecting the output from the disconnection-detection-signal output section other than when the diagnosis for the disconnection is conducted, in which the car is stopped when occurrence of the disconnection is determined by the signal diagnosis device or when the abnormality is detected by the disconnection-detection-signal block section.

Advantageous Effects of Invention

The elevator device according to the present invention uses the signal diagnosis device which includes the disconnection detecting section for outputting the diagnosis signal to the sensor and for detecting the state of the signal turned back at the sensor to be input so as to detect whether or not the disconnection of the signal from the sensor occurs. Therefore, the disconnection of the signal from the sensor can be more reliably detected with a simple configuration without specially modifying the sensor. As a result, reliability can be improved.

Moreover, the elevator device according to the present invention uses the signal diagnosis device for detecting the disconnection by feeding the diagnosis signal to a wiring of the sensor only when the diagnosis for disconnection is conducted. Therefore, the disconnection of the signal from the sensor can be more reliably detected with a simple configuration without specially modifying the sensor and the wiring thereof. As a result, the reliability can be improved.

DESCRIPTION OF EMBODIMENTS

Figure 1:
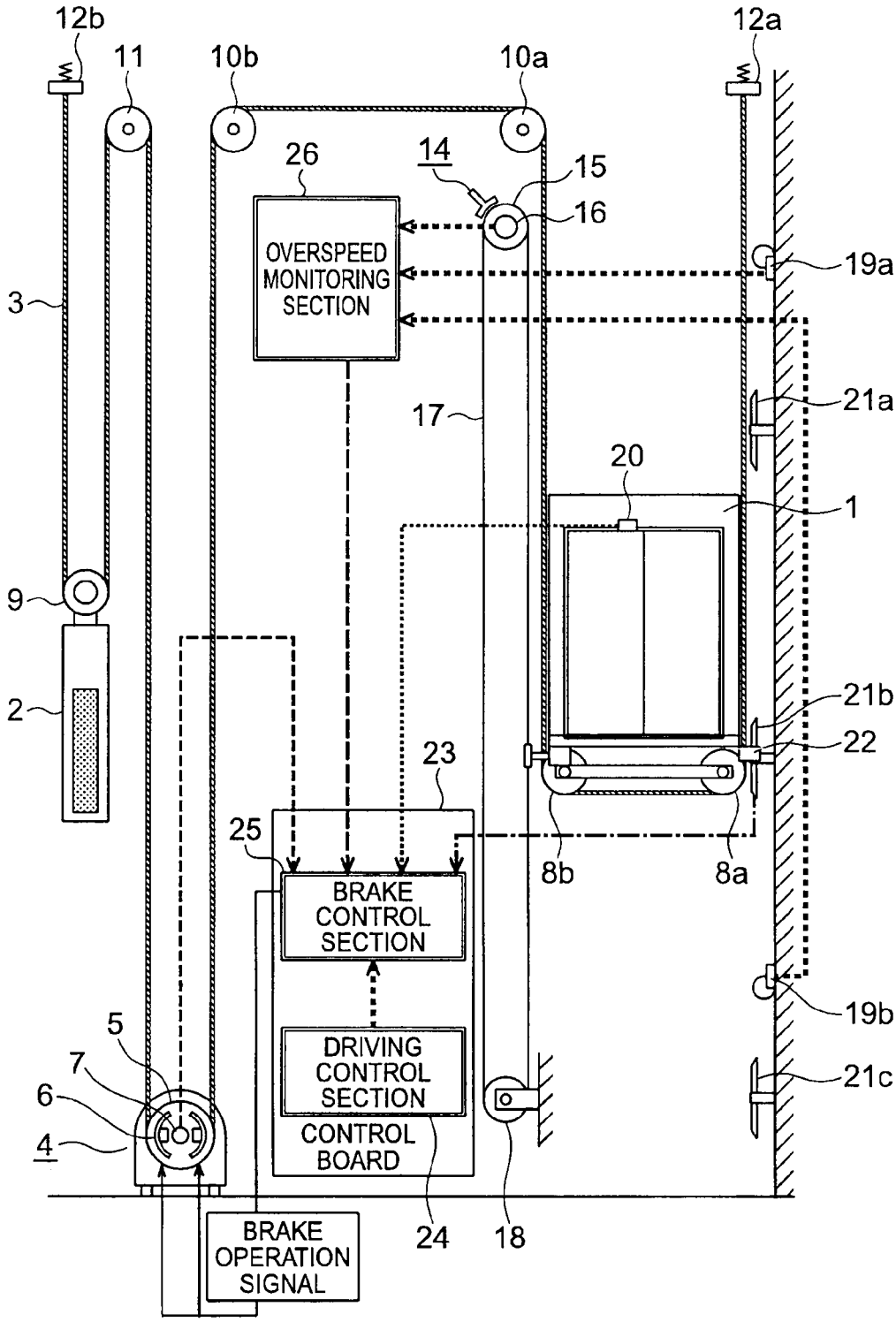
FIG. 1 is a configuration diagram illustrating an elevator device according to Embodiment 1 of the present invention.

Hereinafter, embodiments of the present invention are described referring to the drawings.

Embodiment 1

FIG. 1 is a configuration diagram illustrating an elevator device according to Embodiment 1 of the present invention. In the figure, a car 1 and a counterweight 2 are suspended by suspension means 3 in a hoistway. The suspension means 3 includes a plurality of ropes or belts.

Ina lower part of the hoistway, a hoisting machine 4 for raising and lowering the car 1 and the counterweight 2 is provided. The hoisting machine 4 includes a driving sheave 5 around which the suspension means 3 is looped, a hoisting-machine motor for generating a driving torque to rotate the driving sheave 5, a hoisting-machine brake 6 corresponding to braking means for generating a braking torque to brake the rotation of the driving sheave 5, and a hoisting-machine encoder 7 for generating a signal according to the rotation of the driving sheave 5.

As the hoisting-machine brake 6, an electromagnetic brake device is used, for example. In the electromagnetic brake device, brake shoes are pressed against a braking surface by spring forces of braking springs to brake the rotation of the driving sheave 5, thereby braking the car 1. By exciting electromagnetic magnets, the brake shoes are separated away from the braking surface to release a braking force. Further, the braking force applied by the hoisting-machine brake 6 is changed according to a current value flowing through the brake coils of the electromagnetic magnets.

A pair of car-suspending sheaves 8*a* and 8*b* are provided to the car 1. A counterweight-suspending sheave 9 is provided to the counterweight 2. In an upper part of the hoistway, car-return sheaves 10*a* and 10*b* and a counterweight-return sheave 11 are provided. A first end portion of the suspension means 3 is connected to a first rope fastener 12*a* provided in the upper part of the hoistway. A second end portion of the suspension means 3 is connected to a second rope fastener 12*b* provided in the upper part of the hoistway.

The suspension means 3 is looped around the car-suspending sheaves 8*a* and 8*b*, the car-return sheaves 10*a* and 10*b*, the driving sheave 5, the counterweight return sheave 11, and the counterweight-suspending sheave 9 in the stated order from the first end portion side. Specifically, the car 1 and the counterweight 2 are suspended in the hoistway by 2:1 roping.

In the upper part of the hoistway, a governor 14 is provided. The governor 14 includes a governor sheave 15 and a governor encoder 16 for generating a signal according to the rotation of the governor sheave 15. A governor rope 17 in a looped shape is looped around the governor sheave 15. The governor rope 17 is connected to an operation lever of a safety device mounted to the car 1. A lower end of the loop of the governor rope 17 is looped around a tension sheave 18 provided in the lower part of the hoistway. When the car 1 is raised and lowered, the governor rope 17 is circulated. As a result, the governor sheave 15 is rotated at a rotation speed according to a running speed of the car 1.

In the upper part of the hoistway, an upper reference-position switch 19*a* for detecting a position of the car 1 is provided. In the lower part of the hoistway, a lower reference-position switch 19*b* for detecting the position of the car 1 is provided. A switch operating member (cam) for operating the reference-position switches 19*a* and 19*b* is provided to the car 1.

A car-door switch 20 for detecting opening/closing of a car door is provided on the top of the car 1. A landing-door switch for detecting opening/closing of a landing door is provided to a landing at each floor. Moreover, in the hoistway, a plurality of floor-alignment plates 21*a* to 21*c* for detecting that the car 1 is located at a position (in a door zone) which allows a passenger to safely board and deboard the car 1 are provided. A floor-alignment sensor 22 for detecting the floor-alignment plates 21*a* to 21*c* is provided to the car 1.

Each of the hoisting-machine encoder 7, the governor encoder 16, the reference-position switches 19*a* and 19*b*, the car-door switch 20, the landing-door switches, and the floor-alignment sensor 22 is a sensor which generates a signal according to a state of the car 1.

In the hoistway, a control board 23 is provided. In the control board 23, a driving control section (driving control board) 24 corresponding to a travel control section and a brake control section (brake control board) 25 corresponding to one of safety monitoring sections are provided. The driving control section 24 controls an operation of the hoisting machine 4, that is, a travel of the car 1. The driving control section 24 also controls a running speed of the car 1 based on a signal from the hoisting-machine encoder 7. Further, the driving control section 24 outputs a brake operation command for keeping the car 1 stopped at the landing and a brake release command for allowing the running of the car 1 to the brake control section 25.

The brake control section 25 acquires a brake operation command from the driving control section 24 and then outputs a brake operation signal to the hoisting-machine brake 6 in response to the operation command. The brake control section 25 can control the braking force (braking torque) generated by the hoisting-machine brake 6 by controlling the current flowing through the brake coils of the hoisting-machine brake 6. The braking force generated by the hoisting-machine brake 6 is reduced by increasing a current value of the brake coils. When the current value exceeds a predetermined value, the braking force becomes zero. On the other hand, when the current value of the brake coils is reduced, the braking force is increased. When the current value becomes zero, the braking force becomes maximum.

The brake control section 25 uses a signal from the floor-alignment sensor 22 to determine whether or not the car 1 is present at a landing position. Further, the brake control section 25 uses signals from the car-door switch 20 and the landing-door switch to determine an open/closed state of each of the car door and the landing door. Further, the brake control section 25 uses a signal from the hoisting-machine encoder 7 to determine whether or not the car 1 is currently running.

The brake control section 25 detects a state in which at least any one of the car door and the landing door is open although the car 1 has not arrived at a landing position and a state in which at least any one of the car door and the landing door is open although the car 1 is currently running, and then outputs a brake operation command. Specifically, when detecting a running state with a door open, the brake control section 25 brakes the driving sheave 5 by the hoisting-machine brake 6 and also stops the hoisting-machine motor to forcibly stop the car 1.

Signals from the hoisting-machine encoder 16 and the reference-position switches 19*a* and 19*b* are input to an overspeed monitoring section (overspeed monitoring board) 26 corresponding to another safety monitoring section. The overspeed monitoring section 26 uses the signals from the governor encoder 16 and the reference-position switches 19*a* and 19*b* to obtain a position and a speed of the car 1 independently of the driving control section 24 so as to monitor whether or not the speed of the car 1 reaches a predetermined overspeed level. The overspeed level is set as an overspeed monitoring pattern changing according to the position of the car 1.

When the speed of the car 1 reaches the overspeed level, the overspeed monitoring section 26 transmits a forcible stop signal to the brake control section 25. When receiving the forcible stop signal, the brake control section 25 brakes the driving sheave 5 by the hoisting-machine brake 6 and also stops the hoisting-machine motor to forcibly stop the car 1.

Each of the driving control section 24, the brake control section 25, and the overspeed monitoring section 26 includes an independent microcomputer. The functions of the driving control section 24, the brake control section 25, and the overspeed monitoring section 26 are realized by the microcomputers.

In the elevator device described above, there is a fear that a problem occurs in a safety system if the signal from each of the switches and sensors is erroneous. Therefore, means for detecting an error or a failure for each input signal is required. In the safety system for the elevator system, a signal relating to safety control is duplicated. A difference is detected by comparing the input signals obtained by duplication with each other when a problem is generated in one of the input signals. In this manner, the problem in the input signal is detected.

While the car 1 stops at a floor for a long period of time, there is no (change in) input signal from each of the hoisting-machine encoder 7 and the governor encoder 16. Therefore, even if a problem occurs in one of the input signals, the problem cannot be detected. Further, a problem occurs even in the other input signal. As a result, the problem cannot be detected at all.

On the other hand, if disconnection of a cable, which is a main problem of the signal, is detected, the problem of the input signal can be detected even when the car 1 stops at a floor for a long period of time. The disconnection of the cable of the elevator device is frequently due to unintended removal of a connector.

Figure 2:
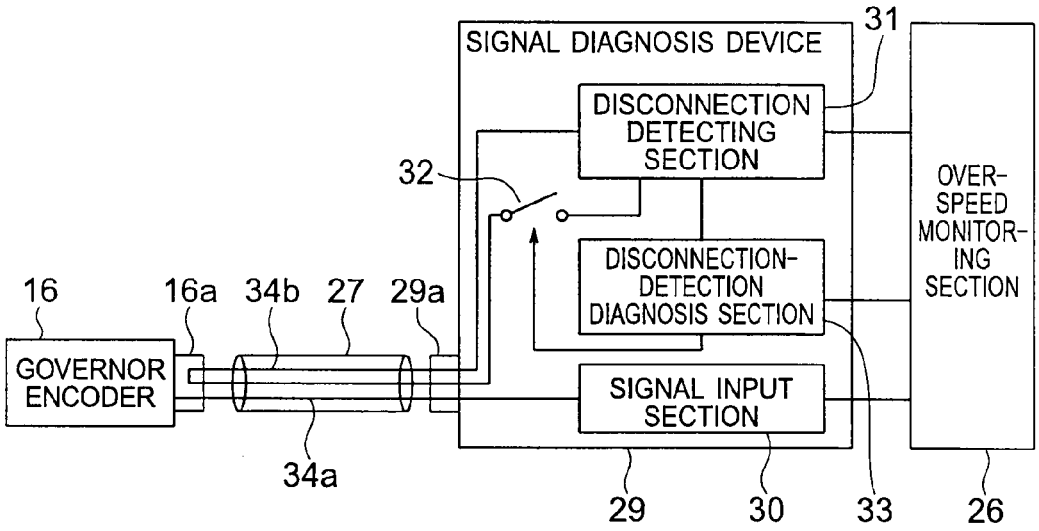
FIG. 2 is a block diagram illustrating a state of connection between a governor encoder and an overspeed monitoring section which are illustrated in FIG. 1.

FIG. 2 is a block diagram illustrating a state of connection between the governor encoder 16 and the overspeed monitoring section 26 illustrated in FIG. 1. A sensor signal from the governor encoder 16 is transmitted to the overspeed monitoring section 26 through a cable 27 and a signal diagnosis device 29. The signal diagnosis device 29 makes a diagnosis for whether or not the signal from the governor encoder 16 is normal. The signal diagnosis device 29 also makes a diagnosis for whether or not its own signal diagnosis function is normal.

The signal diagnosis device 29 is provided in the vicinity of the overspeed monitoring section 26 and is directly connected to the overspeed monitoring section 26 without through an intermediation of a cable. Therefore, the signal diagnosis device 29 may be configured as a part of the overspeed monitoring section 26 on the same board.

An encoder connector 16*a*, to which a first end of the cable is connected, is provided to the governor encoder 16. A diagnosis-device connector 29*a*, to which a second end of the cable 27 is connected, is provided to the signal diagnosis device 29.

The signal diagnosis device 29 includes a signal input section 30 to which the sensor signal from the governor encoder 16 is input, a disconnection detecting section 31 for detecting the disconnection of a diagnosis signal for detecting disconnection, an input switch 32 for turning ON/OFF input to the disconnection detecting section 31, and a disconnection-detection diagnosis section 33 for operating the input switch 32. The signal input section 30 inputs the sensor signal from the governor encoder 16 to the overspeed monitoring section 26. The disconnection-detection diagnosis section 33 opens the input switch 32 to bring about a state in which the diagnosis signal is disconnected so as to make a diagnosis for whether or not the disconnection detecting section 31 functions normally.

A signal line 34*a* for inputting the sensor signal from the governor encoder 16 is connected to the overspeed monitoring section 26 through an intermediation of the signal input section 30. On the other hand, a signal line 34*b* for detecting disconnection extends from the disconnection detecting section 31 to pass through the cable 27 and is turned back at the encoder connector 16*a* to pass through the cable 27 again to return to the disconnection detecting section 31.

The disconnection detecting section 31 detects disconnection based on a state of the signal line 34 for detecting disconnection. For example, the disconnection detecting section 31 outputs a diagnosis signal at High level (for example, 5 V), which is input after the turned-back signal line 34*b* for detecting disconnection is pulled down (the signal line 34*b* is connected to a grounding conductor (ground) through an intermediation of a resistor). As a result, if the disconnection does not occur, the signal at High level is input. However, when the disconnection occurs and the signal is not generated, a signal at Low level (for example, 0 V) is always input. When detecting a state in which the signal at Low level is always input, the disconnection detecting section 31 determines the occurrence of disconnection and therefore outputs a disconnection detection signal to the overspeed monitoring section 26 and the disconnection-detection diagnosis section 33.

However, when a failure occurs in a circuit of the disconnection detecting section 31 and therefore, for example, a state in which the signal at High level is always detected in spite of the occurrence of disconnection is brought about, the disconnection cannot be detected. Therefore, the disconnection-detection diagnosis section 33 operates the input switch 32 to block the input to the disconnection detecting section 31 so as to inspect an operation of the disconnection detecting section 31 at that time. In this manner, whether or not a failure (abnormality) occurs in the disconnection detecting section 31 is diagnosed.

The functions of the signal diagnosis device 29 can be realized by a microcomputer different from that of the overspeed monitoring section 26 or the same microcomputer as that of the overspeed monitoring section 26. The functions of the signal diagnosis device 29 can also be realized by an analog circuit.

Figure 3:
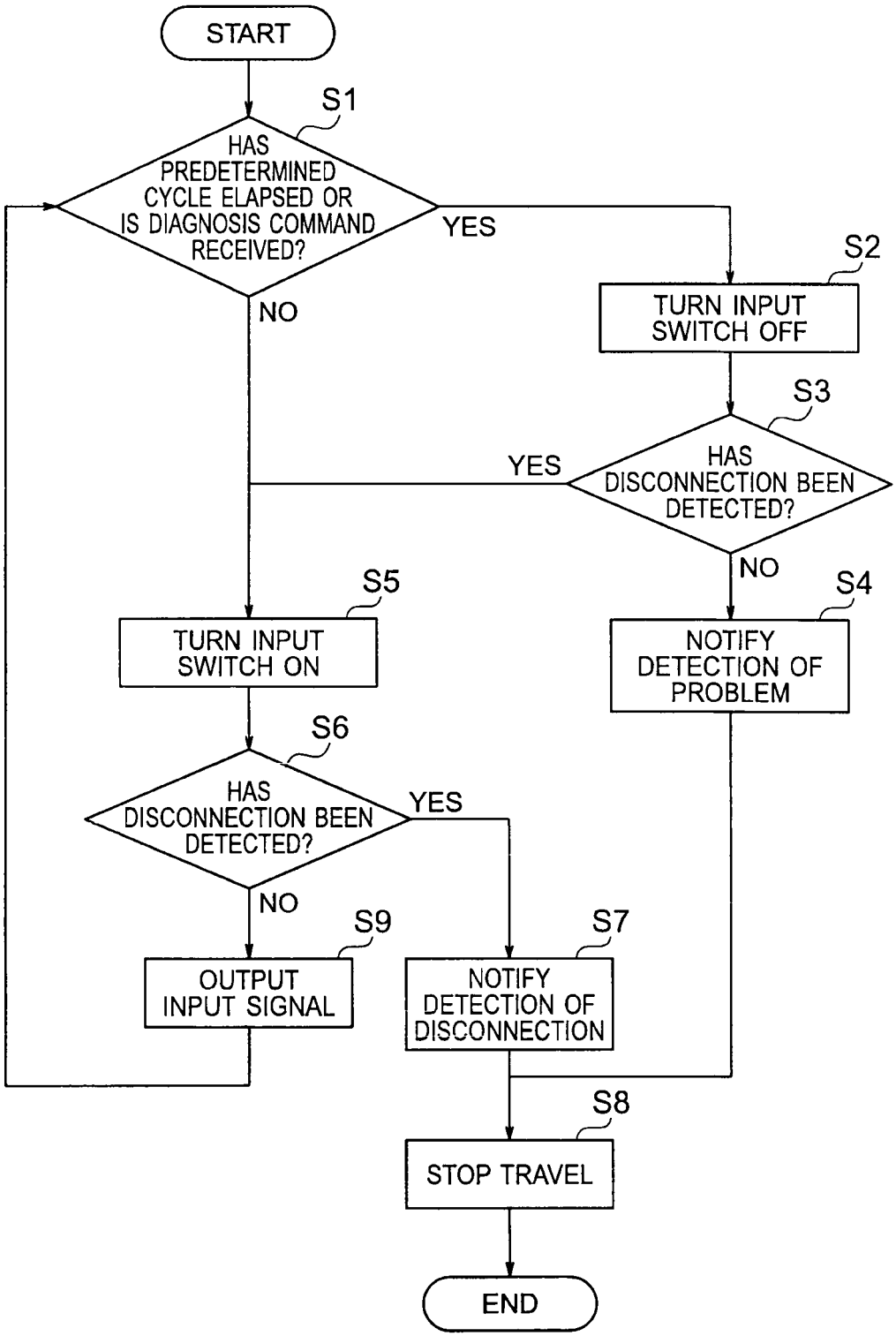
FIG. 3 is a flowchart illustrating a disconnection detection operation and a disconnection-detection-function diagnosis operation of a signal diagnosis device illustrated in FIG. 2.

FIG. 3 is a flowchart illustrating a disconnection detection operation and a disconnection-detection-function diagnosis operation of the signal diagnosis device 29 illustrated in FIG. 2. When a command from the overspeed monitoring section 26 is received or after elapse of a predetermined cycle (Step S1), the disconnection-detection diagnosis section 33 turns the input switch 32 OFF to block the input signal to the disconnection detecting section 31 (Step S2). In this step, when the disconnection detecting section 31 is normal, the disconnection detection signal is input from the disconnection detecting section 31 to the disconnection-detection diagnosis section 33. Therefore, the disconnection-detection diagnosis section 33 verifies whether or not the disconnection detection signal has been input (Step S3).

When the disconnection detection signal has not been input, it is determined that the problem (abnormality) occurs in the disconnection detecting section 31. Therefore, the overspeed monitoring section 26 is notified of the detection of the problem (determination of occurrence of the failure) (Step S4). Then, a travel of the car 1 is stopped by the overspeed monitoring section 26 (Step S8).

In this step, the car 1 may be immediately stopped regardless of the position thereof. However, the car 1 may be stopped at the closest floor to allow a passenger(s) to deboard so as to prevent the passenger(s) from being trapped. This is applied even to the case where the travel of the car 1 is stopped in the following description (including embodiments other than Embodiment 1).

On the other hand, when the disconnection detection signal from the disconnection detecting section 31 is input to the disconnection-detection diagnosis section 33, it is determined that the disconnection detecting section 31 is normal. Therefore, the input switch 32 is turned ON to achieve a normal state (Step S5).

In the normal state, the disconnection detecting section 31 always checks whether or not the disconnection occurs (Step S6). When the disconnection is not detected, the input signal from the governor encoder 16 is output to the overspeed monitoring section 26 (Step S9). When the disconnection is detected, the overspeed monitoring section 26 is notified of the detection of the disconnection (Step S7). Then, the travel of the car 1 is stopped by the overspeed monitoring section 26 (Step S8).

Figure 4:
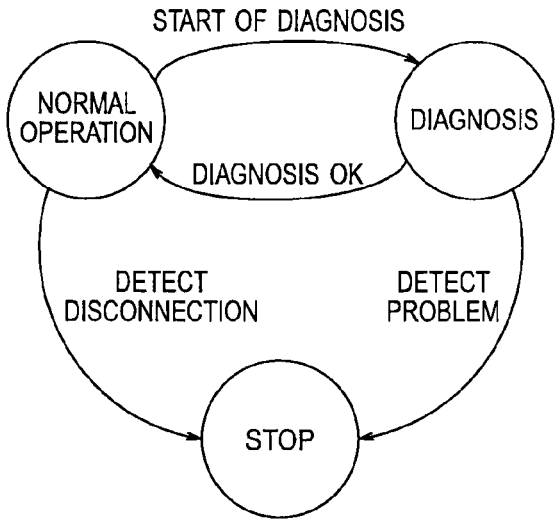
FIG. 4 is an explanatory diagram illustrating a state transition by the disconnection detection operation and the disconnection-detection-function diagnosis operation of the signal diagnosis device illustrated in FIG. 2.

FIG. 4 is an explanatory diagram illustrating a state transition by the disconnection detecting operation and the disconnection-detection-function diagnosis operation of the signal diagnosis device 29 illustrated in FIG. 2. The overspeed monitoring section 26 uses the signal from the governor encoder 16 to perform overspeed monitoring during a normal operation. However, when the disconnection detection signal is output from the disconnection detecting section 31 or a notification of occurrence of the problem is output from the disconnection-detection diagnosis section 33, the travel of the car 1 is stopped.

According to the elevator device described above, the disconnection due to the unintended removal of the connector can be more reliably detected with a simple configuration without specially modifying the governor encoder 16. Moreover, the abnormality of the disconnection detecting section 31 is detected to enable the improvement of reliability.

In Embodiment 1, the detection of the disconnection of the signal from the governor encoder 16 has been described. However, the present invention is also applicable to the detection of disconnection of a signal from other sensors, for example, the hoisting-machine encoder 7, the reference-position switches 19*a* and 19*b*, the car-door switch 20, the landing-door switches, the floor-alignment sensor 22, or a weighing device.

In Embodiment 1, the detection of disconnection of the input signal to the overspeed monitoring section 26 has been described. However, the present invention is also applicable to the detection of disconnection of the input signal to other safety monitoring sections, for example, the brake control section 25.

Embodiment 2

Figure 5:
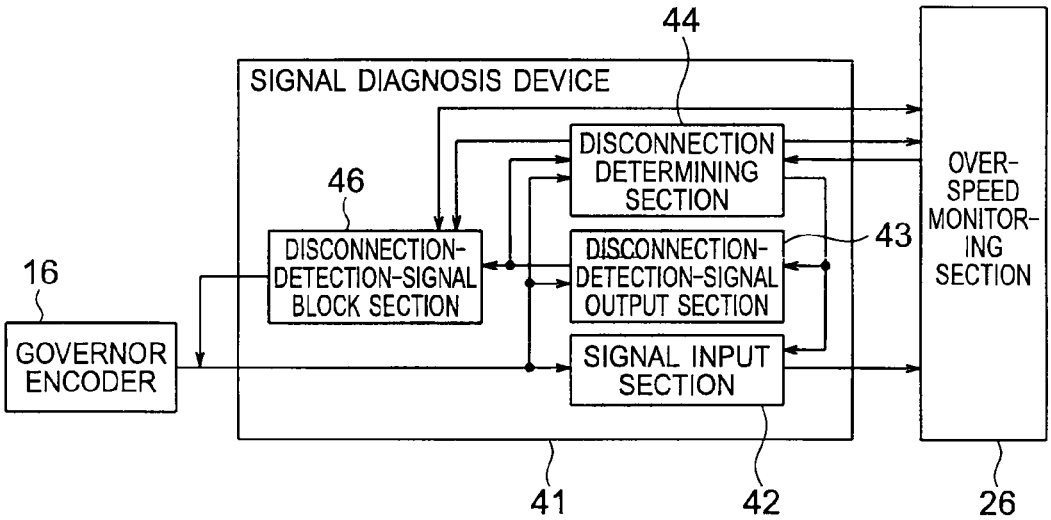
FIG. 5 is a block diagram illustrating a state of connection between the governor encoder and the overspeed monitoring section of an elevator device according to Embodiment 2 of the present invention.

Next, FIG. 5 is a block diagram illustrating a state of connection between the governor encoder 16 and the overspeed monitoring section 26 of an elevator device according to Embodiment 2 of the present invention. A configuration of the entire elevator device is the same as that of Embodiment 1 (FIG. 1). In the figure, a signal diagnosis device 41 is connected between the governor encoder 16 and the overspeed monitoring section 26.

The signal diagnosis device 41 includes a signal input section 42 to which the sensor signal from the governor encoder 16 is input, a disconnection-detection-signal output section 43 for outputting a diagnosis signal for detecting disconnection to (for causing the diagnosis signal to interrupt) the sensor signal from the governor encoder 16 when the diagnosis for disconnection is conducted, a disconnection determining section 44 for determining whether or not the disconnection has occurred by comparing the input signal from the governor encoder 16 and an output signal from the disconnection-detection-signal output section 43, and a disconnection-detection-signal block section 46 for blocking the output signal from the disconnection-detection-signal output section 43 other than when the diagnosis for disconnection is conducted.

Normally, the sensor signal from the governor encoder 16 is input to the overspeed monitoring section 26 through the signal input section 42. The overspeed monitoring section 26 outputs a diagnosis command to the disconnection determining section 44 when the diagnosis for disconnection is conducted. When the diagnosis command from the overspeed monitoring section 26 is received or after the elapse of a predetermined cycle, the disconnection determining section 44 outputs the diagnosis command to the disconnection-detection-signal output section 43, the signal input section 42, and the disconnection-detection-signal block section 46.

When receiving the diagnosis command from the disconnection determining section 44, the disconnection-detection-signal output section 43 outputs the diagnosis signal to the disconnection-detection-signal block section 46. The diagnosis signal output from the disconnection-detection-signal output section 43 is input to a signal line for the sensor signal at the position as close as possible to the governor encoder 16 (for example, at a signal output section such as the connector) through the disconnection-detection-signal block section 46 and a signal line for a diagnosis signal.

The diagnosis signal is a pulse signal having an output that is opposite to the input of the sensor signal from the governor encoder 16 to the signal input section 42 (for example, when the sensor signal is at High level, the diagnosis signal is at Low level). This is merely for enabling the distinction between the sensor signal and the diagnosis signal. The diagnosis signal is caused to interrupt the sensor signal for a period of time shorter than a signal processing effective time of the signal input section 42. As a result, the disconnection can be detected even during the travel of the car 1.

Until the diagnosis command is received, the disconnection-detection-signal block section 46 blocks all the signals output from the disconnection-detection-signal output section 43. However, after the reception of the diagnosis command, the passage of the signal is allowed. Alternatively, the disconnection-detection-signal block section 46 includes a timer (not shown) preset with a time limit. The timer is activated and the passage of the signal input from the disconnection-detection-signal block section 46 is allowed by rise (start) of the diagnosis command. Based on the time limit of the timer, the signal output from the disconnection-detection-signal output section 43 is blocked.

Therefore, if the signal diagnosis device 41 is normal, the diagnosis signal is output from the disconnection-detection-signal output section 43 when the diagnosis command is generated. The diagnosis signal is input to the signal line for the sensor signal through the disconnection-detection-signal block section 46.

The diagnosis signal from the disconnection-detection-signal output section 43 is also input to the disconnection determining section 44. The disconnection determining section 44 uses the output from the disconnection-detection-signal output section 43 and the input to the signal input section 42 as inputs to compare the signals with each other. At this time, when the signal line for the sensor signal is not disconnected, the same diagnosis signal as that detected for the output from the disconnection-detection-signal output section 43 is detected for the input to the signal input section 42. Therefore, the disconnection determining section 44 diagnoses that no disconnection occurs when the two signals are identical and diagnoses that the disconnection occurs when the two signals are not identical, and outputs the results of diagnosis to the overspeed monitoring section 26.

When the diagnosis command is not received or the output from the disconnection-detection-signal output section 43 is detected after the time limit of the timer is over, the disconnection-detection-signal block section 46 determines that the abnormality occurs in the signal diagnosis device 41 and then outputs an abnormality detection signal to the overspeed monitoring section 26.

When receiving the results of diagnosis which indicate the occurrence of disconnection from the disconnection determining section 44 or receiving the abnormality detection signal from the disconnection-detection-signal block section 46, the overspeed monitoring section 26 stops the travel of the car 1 to bring the car into a safe state.

The signal input section 42 invalidates a change in output over a short period of time and then outputs the signal to the overspeed monitoring section 26. In other words, the output of the diagnosis signal for detecting disconnection and the diagnosis of disconnection are performed within a period of time shorter than the signal processing effective time of the signal input section 42. As a result, the diagnosis for disconnection can be conducted within a short period of time which does not adversely affect the travel of the car 1. Therefore, the disconnection of the signal line itself for the sensor signal can be detected even during the travel of the car 1. Moreover, the travel of the car 1 can be prevented from being adversely affected by the abnormality of the disconnection-detection-signal output section 43.

Figure 6:
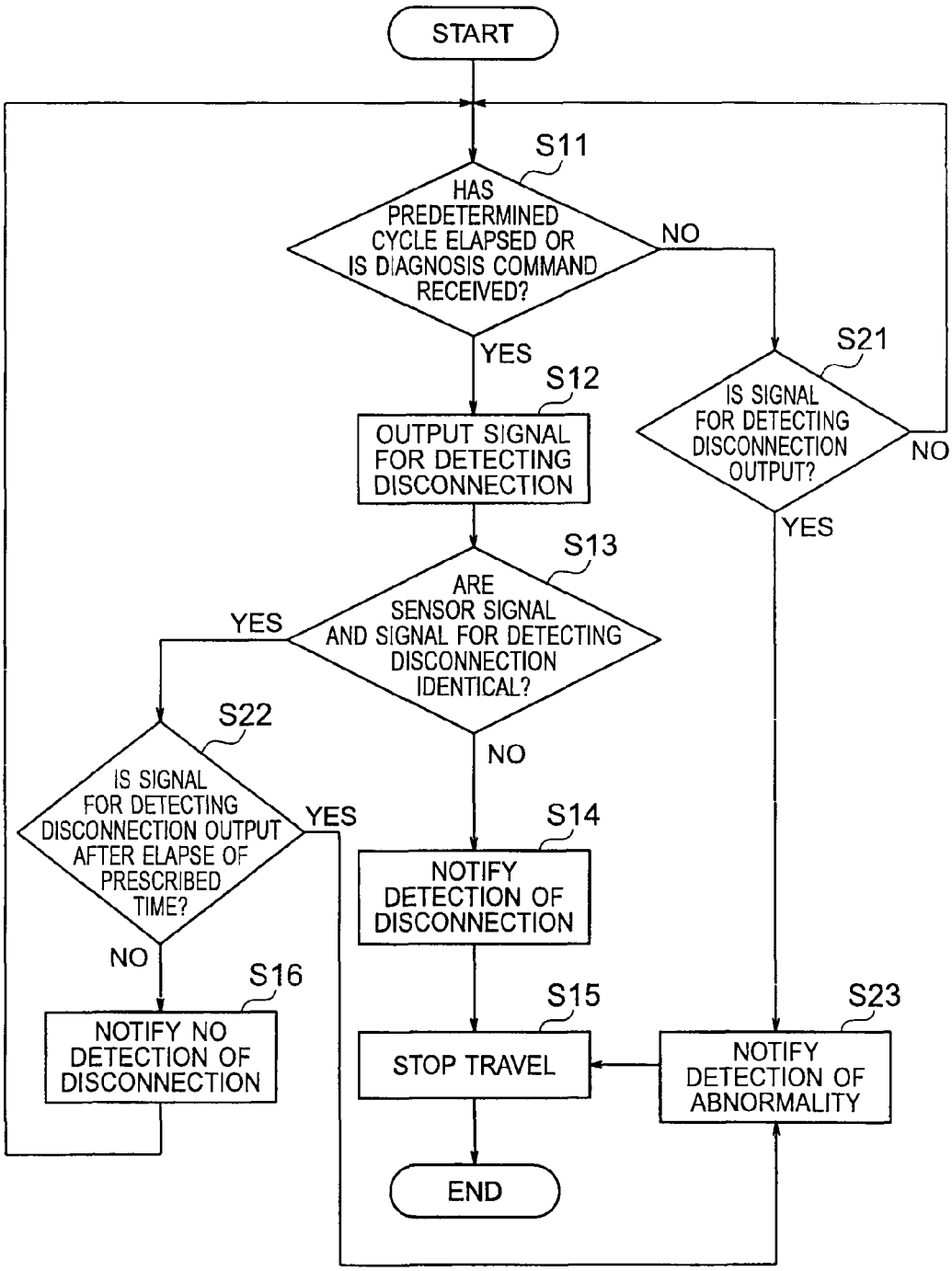
FIG. 6 is a flowchart illustrating a disconnection detection operation of a signal diagnosis device illustrated in FIG. 5.

FIG. 6 is a flowchart illustrating a disconnection detection operation of the signal diagnosis device 41 illustrated in FIG. 5. When receiving the diagnosis command from the overspeed monitoring section 26 or after the elapse of a predetermined cycle (Step S11), the diagnosis determining section 44 outputs the diagnosis command to the disconnection-detection-signal output section 43. When the disconnection detection signal (diagnosis signal) is output from the disconnection-detection-signal output section 43 even though the diagnosis command is not received or the predetermined cycle has not elapsed (Step S21), the disconnection-detection-signal block section 46 informs the overspeed monitoring section 26 of the detection of the abnormality (Step S23) and stops the travel of the car 1 (Step S15).

The disconnection-detection-signal output section 43, which has received the diagnosis command, receives information about a state (for example, High) of the sensor signal output from the governor encoder 16, from the signal input section 42, and outputs the diagnosis signal in a state opposite (for example, Low) to the signal state (Step S12). The disconnection-detection-signal block section 46 activates the timer and releases the blocking of the output of the disconnection-detection-signal output section 43.

Figure 7:
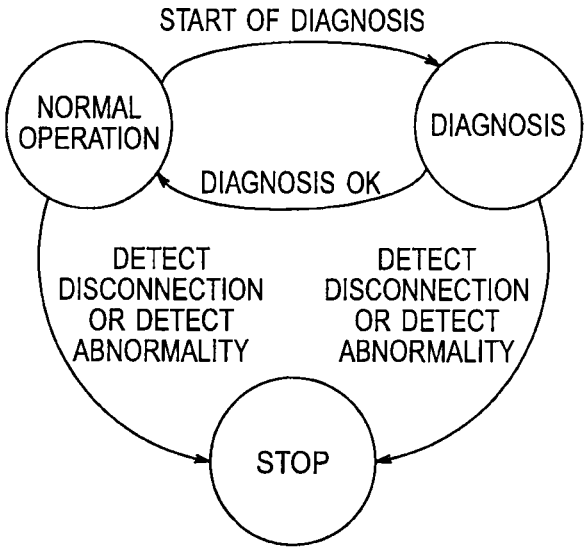
FIG. 7 is an explanatory diagram illustrating a state transition by the diagnosis detection operation illustrated in FIG. 5.

The diagnosis determining section 44 determines whether or not the output signal (diagnosis signal) from the disconnection-detection-signal output section 43 and the input signal which returns through the signal line for the sensor signal are identical with each other (Step S13). When the signals are not identical, the occurrence of disconnection is determined, and the overspeed monitoring section 26 is notified of the occurrence of disconnection (Step S14). Then, the travel of the car 1 is stopped (Step S15). Alternatively, when the disconnection detection signal (diagnosis signal) is output from the disconnection-detection-signal output section 43 after the elapse of a prescribed time based on the operation of the timer (Step S22), the disconnection-detection-signal block section 46 blocks the output of the disconnection-detection-signal output section 43 and notifies the overspeed monitoring section 26 of the detection of the abnormality (Step S23), and then stops the travel of the car 1 (Step S15). When the signal for detecting the disconnection is not output any more within the prescribed time and the two signals are identical with each other while the signal for detecting disconnection is output, the overspeed monitoring section 26 is notified of occurrence of no disconnection (Step S16). Therefore, the travel of the car 1 is continued. FIG. 7 is an explanatory diagram illustrating a state transition by the disconnection detection operation of the signal diagnosis device 41 illustrated in FIG. 5.

According to the elevator device described above, the disconnection of the signal line can be more reliably detected with a simple configuration without specially modifying the governor encoder 16. Therefore, the reliability can be improved.

The signal diagnosis device 41 of Embodiment 2 is also provided in the vicinity of the overspeed monitoring section 26 and is directly connected to the overspeed monitoring section 26 without through an intermediation of the cable. Therefore, the signal diagnosis device 41 may be configured as a part of the overspeed monitoring section 26 on the same board.

Moreover, the functions of the signal diagnosis device 41 of Embodiment 2 can also be realized by a microcomputer different from that of the overspeed monitoring section 26, the microcomputer shared by the overspeed monitoring section 26, or an analog circuit.

In Embodiment 2, the detection of disconnection of the signal from the governor encoder 16 has been described. However, the present invention is also applicable to the detection of disconnection of a signal from other sensors, for example, the hoisting-machine encoder 7, the reference-position switches 19*a* and 19*b*, the car-door switch 20, the landing-door switches, the floor-alignment sensor 22, or the weighing device.

Further, in Embodiment 2, the detection of disconnection of the input signal to the overspeed monitoring section 26 has been described. However, the present invention is also applicable to the detection of disconnection of the input signal to other safety monitoring sections, for example, the brake control section 25.

Further, the signal diagnosis device 29 of Embodiment 1 and the signal diagnosis device 41 of Embodiment 2 may be used in combination.

Embodiment 3

Figure 8:
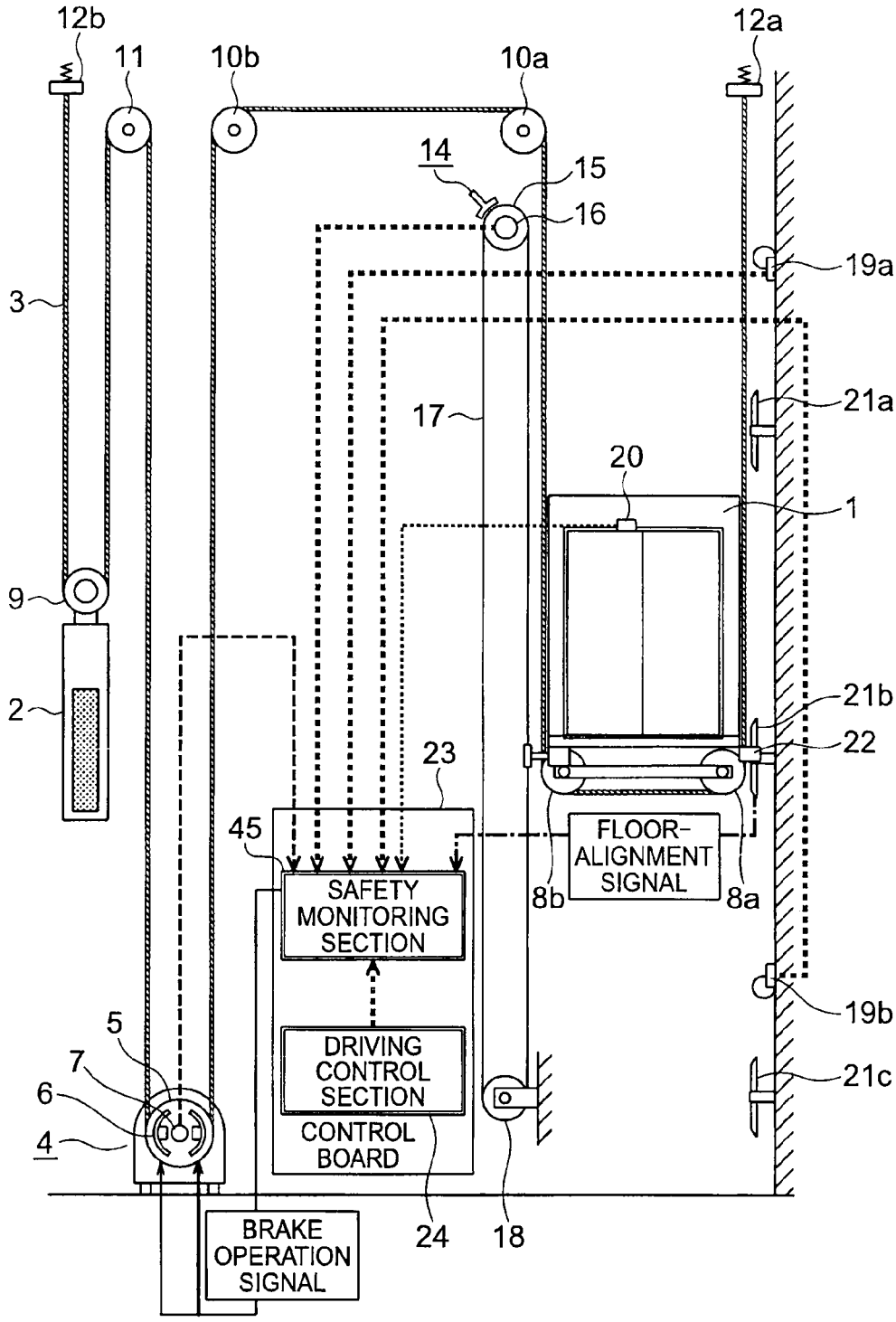
FIG. 8 is a configuration diagram illustrating an elevator device according to Embodiment 3 of the present invention.

Next, FIG. 8 is a configuration diagram illustrating an elevator device according to Embodiment 3 of the present invention. In this example, a safety monitoring section 45 having the functions of both the brake control section 25 and the overspeed monitoring section 26 of Embodiments 1 and 2 is provided to the control board 23.

Even in the elevator device having the system configuration described above, the disconnection of the signal line can be more reliably detected with a simple configuration by using the signal diagnosis device 29 according to Embodiment 1 or the signal diagnosis device 41 according to Embodiment 2. As a result, the reliability can be improved.

The sensor is not limited to the examples of Embodiments 1 to 3, and may be the weighing device for detecting a load in the car or the like, for example, used.

The overall layout and the roping method of the elevator device are not limited to those illustrated in FIGS. 1 and 8. The locations where the hoisting machine 4, the driving control section 24, the brake control section 25, the overspeed monitoring section 26, the safety monitoring section 45, and the like are provided are not particularly limited.

The invention claimed is:

1. An elevator device, comprising a signal diagnosis device, the signal diagnosis device comprising:

a disconnection detecting section for detecting whether or not disconnection of a signal from a sensor which generates a signal according to a state of the elevator occurs;

a switch for turning ON/OFF an input of the signal to the disconnection detecting section; and a disconnection-detection diagnosis section for operating the switch to diagnose whether or not the disconnection detecting section functions normally, wherein a car of the elevator is stopped when occurrence of the disconnection is determined by the signal diagnosis device or when an abnormality is detected by the disconnection-detection diagnosis section.

2. An elevator device according to claim 1, wherein:

the sensor and the signal diagnosis device are connected to each other through an intermediation of a cable;

a connector to which the cable is to be connected is provided to the sensor;

a signal line for the sensor signal from the sensor is connected to the signal diagnosis device through an intermediation of the cable; and a signal line for detecting the disconnection extends from the disconnection detecting section to pass through the cable and is turned back at the connector to pass through the cable again to return to the disconnection detecting section.

3. An elevator device, comprising a signal diagnosis device, the signal diagnosis device comprising:

a signal input section to which a sensor signal from a sensor for generating a signal according to a state of the elevator is input;

a disconnection-detection-signal output section for outputting a diagnosis signal for detecting disconnection to the sensor signal from the sensor when a diagnosis for disconnection is conducted;

a disconnection determining section for comparing an input signal from the sensor and an output signal from the disconnection-detection-signal output section with each other to determine whether or not the disconnection of the signal from the sensor occurs; and a disconnection-detection-signal block section for blocking the output signal from the disconnection-detection-signal output section other than when the diagnosis for the disconnection is conducted and determining occurrence of an abnormality when detecting the output from the disconnection-detection-signal output section other than when the diagnosis for the disconnection is conducted, wherein a car of the elevator is stopped when occurrence of the disconnection is determined by the signal diagnosis device or when the abnormality is detected by the disconnection-detection-signal block section.

4. An elevator device according to claim 3, wherein the disconnection-detection-signal output section outputs a signal in a state opposite to a state of the sensor signal from the sensor as the diagnosis signal.

5. An elevator device according to claim 3, wherein the disconnection-detection-signal output section causes the diagnosis signal to interrupt the sensor signal from the sensor for a period of time shorter than a signal processing effective time of the signal input section.

6. An elevator device according to claim 3, wherein the disconnection-detection-signal block section activates a timer when receiving a signal indicating conduct of the diagnosis, and blocks the output signal from the disconnection-detection-signal output section when a time limit of the timer is over.

7. An elevator device according to claim 1, wherein the car is immediately stopped when the disconnection is determined by the signal diagnosis device or when the abnormality is detected by the disconnection-detection diagnosis section.

8. An elevator device according to claim 1, wherein the car is stopped at a closest floor when the disconnection is determined by the signal diagnosis device or when the abnormality is detected by the disconnection-detection diagnosis section.

9. An elevator device according to claim 1, wherein:

the disconnection detecting section outputs a diagnosis signal for detecting disconnection to the sensor and detects a state of a signal turned back at the sensor to be input so as to detect whether or not disconnection of the signal from the sensor occurs.

10. An elevator device according to claim 3, wherein the car is immediately stopped when the disconnection is determined by the signal diagnosis device or when the abnormality is detected by the disconnection-detection-signal block section.

11. An elevator device according to claim 3, wherein the car is stopped at a closest floor when the disconnection is determined by the signal diagnosis device or when the abnormality is detected by the disconnection-detection-signal block section.

* * * * *